US009238849B2

(12) United States Patent
Koh et al.

(10) Patent No.: US 9,238,849 B2
(45) Date of Patent: Jan. 19, 2016

(54) STEEL SHEET FOR AN OIL SAND SLURRY PIPE HAVING EXCELLENT ABRASION RESISTANCE, CORROSION RESISTANCE, AND LOW-TEMPERATURE TOUGHNESS AND METHOD FOR MANUFACTURING SAME

(75) Inventors: Seong-Ung Koh, Pohang-si (KR); Hwan-Gyo Jung, Pohang-si (KR)

(73) Assignee: POSCO, Pohang-si (KR)

( * ) Notice: Subject to any disclaimer, the term of this patent is extended or adjusted under 35 U.S.C. 154(b) by 266 days.

(21) Appl. No.: 13/996,563

(22) PCT Filed: Dec. 21, 2011

(86) PCT No.: PCT/KR2011/009943

§ 371 (c)(1),
(2), (4) Date: Jun. 21, 2013

(87) PCT Pub. No.: WO2012/087028

PCT Pub. Date: Jun. 28, 2012

(65) Prior Publication Data

US 2013/0284324 A1 Oct. 31, 2013

(30) Foreign Application Priority Data

Dec. 23, 2010 (KR) ..... 10-2010-0133232

(51) Int. Cl.

| | |
|---|---|
| ***C22C 38/48*** | (2006.01) |
| ***C22C 38/08*** | (2006.01) |
| ***C22C 38/50*** | (2006.01) |

(Continued)

(52) U.S. Cl.

CPC ..... *C21D 8/0263* (2013.01); *C21D 8/0205* (2013.01); *C21D 9/46* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/48* (2013.01); *C22C 38/50* (2013.01); *C22C 38/58* (2013.01);

(Continued)

(58) Field of Classification Search

None

See application file for complete search history.

(56) References Cited

U.S. PATENT DOCUMENTS

| | | | |
|---|---|---|---|
| 7,794,651 | B2 | 9/2010 | Beguinot et al. |
| 2005/0087269 | A1 | 4/2005 | Merwin |
| 2010/0147424 | A1 | 6/2010 | Murota et al. |

FOREIGN PATENT DOCUMENTS

| | | | |
|---|---|---|---|
| CA | 2556574 | A1 | 9/2005 |
| EP | 0242860 | A1 | 10/1987 |

(Continued)

OTHER PUBLICATIONS

Machine-English translation Russian patent 02336320, Bobylev Mikhail Viktorovich et al., Oct. 20, 2008.*

(Continued)

*Primary Examiner* — Deborah Yee

(74) *Attorney, Agent, or Firm* — The Webb Law Firm

(57) ABSTRACT

Provided is a steel sheet for an oil sand slurry pipe having excellent abrasion resistance, corrosion resistance, and low-temperature toughness including 0.2 wt % to 0.35 wt % of carbon (C), 0.1 wt % to 0.5 wt % of silicon (Si), 0.5 wt % to 1.8 wt % of manganese (Mn), 0.1 wt % to 0.6 wt % of nickel (Ni), 0.005 wt % to 0.05 wt % of niobium (Nb), 0.005 wt % to 0.02 wt % of titanium (Ti), 0.03 wt % or less of phosphorous (P), 0.03 wt % or less of sulfur (S), 0.05 wt % or less (excluding 0 wt %) of aluminum (Al), 0.01 wt % or less (excluding 0 wt %) of nitrogen (N), and iron (Fe) as well as other unavoidable impurities as a remainder.

16 Claims, 1 Drawing Sheet

(51) Int. Cl.

| | |
|---|---|
| ***C22C 38/14*** | (2006.01) |
| ***C22C 38/12*** | (2006.01) |
| ***C21D 7/13*** | (2006.01) |
| ***C21D 8/04*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/58*** | (2006.01) |
| *C21D 9/14* | (2006.01) |

(52) U.S. Cl.

CPC ..... *C21D 8/0226* (2013.01); *C21D 9/14* (2013.01); *C21D 2211/005* (2013.01); *C21D 2211/009* (2013.01)

(56) References Cited

FOREIGN PATENT DOCUMENTS

| | | | | |
|---|---|---|---|---|
| EP | 0527276 | A1 | | 8/1991 |
| EP | 0557634 | A1 | | 3/1992 |
| EP | 1516934 | A1 | | 3/2005 |
| EP | 1923477 | A1 | | 8/2006 |
| JP | 57-188647 | | | 11/1982 |
| JP | 58-093855 | | | 6/1983 |
| JP | 63-145754 | | * | 6/1988 |
| JP | 05279738 | A | | 10/1993 |
| JP | 08-295989 | | | 11/1996 |
| JP | 2001-073083 | | | 3/2001 |
| JP | 2001262276 | A | | 9/2001 |
| JP | 2008297571 | A | | 12/2008 |
| JP | 2009007665 | A | | 1/2009 |
| KR | 19870010217 | A | | 11/1987 |
| KR | 20000041284 | A | | 7/2000 |
| KR | 20000046429 | A | | 7/2000 |
| KR | 20010066189 | A | | 7/2001 |
| KR | 20040059177 | A | | 7/2004 |
| KR | 20070017409 | A | | 2/2007 |

OTHER PUBLICATIONS

Machine-English translation of Japanese Patent No. 07-157824, Ochi Tatsuro et al., Jun. 20, 1995.*

Larsen-Badse, J., et al., "Influence of Structure on the Abrasion Resistance of a 1040 Steel", Wear—Elsevier Sequoia S.A., Lausanne—Printed in the Netherlands, Jul. 28, 1969.

* cited by examiner

STEEL SHEET FOR AN OIL SAND SLURRY PIPE HAVING EXCELLENT ABRASION RESISTANCE, CORROSION RESISTANCE, AND LOW-TEMPERATURE TOUGHNESS AND METHOD FOR MANUFACTURING SAME

TECHNICAL FIELD

The present invention relates to a steel sheet for an oil sand slurry pipe having excellent abrasion resistance, corrosion resistance, and low-temperature toughness, and a method of manufacturing the same, and more particularly, to a steel sheet for an oil sand slurry pipe having excellent resistance against abrasion and corrosion generated in a lower portion of an inner wall of a pipe when an oil sand slurry mixed with water is transported for post-processing of oil sands, and excellent impact toughness at a low temperature, and a method of manufacturing the same.

BACKGROUND ART

Among steels being used in the oil sands industry, since the abrasion of the steel of a pipe being used in the transportation of an oil sand slurry in particular occurs due to sand particles having a diameter ranging from 200 μm to 300 μm and its replacement life span is about 1 year, a lot of cost and time are required for the purchase and replacement of steel piping.

Methods of mining oil sands may be broadly classified as an open-pit mining method and an in-situ recovery method, in which the application of a slurry pipe system is essential for the post-processing of oil sand ore in the open-pit mining method. Crushed oil sand ore that has been mixed with water may have the form of a slurry, may include about 35% of sand and about 500 ppm of salt, and may be transported at a speed ranging from 3.5 m/sec to 5.5 m/sec. During the transportation of the slurry, since sand particles may erode steel by moving along a lower end portion of an inner side of a pipe, pipe have been used in a manner in which they are rotated about 3 times a year in order to increase the effective service life of the steel from which they are made.

Also, corrosion due to salt as well as abrasion due to the moving sand may occur in the slurry pipe, and it is problematic that corrosion products formed by the result of the corrosion do not reduce a corrosion rate of the material, but are immediately removed by the moving sand. In particular, the erosion of the material may occur much faster in an environment in which corrosion and abrasion occur simultaneously, such as an operating environment of the oil sand slurry pipe, than an environment in which corrosion and abrasion occur separately.

There is a case in which a carbide coating treatment or a surface heat treatment is performed on the inside of the pipe in order to extend the lifespan of the pipe by delaying such erosion. However, since costs for such reprocessing process exceed replacement costs of the material, there is a need to develop a material having excellent resistance to the erosion caused by the slurry without the need for reprocessing.

In general, it is known that abrasion resistance of a material increases with an increase in hardness. However, since a pipe material must have strength and ductility suitable for pipe production in terms of characteristics thereof, it may be impossible to use high-hardness martensite for increasing the hardness of the material. Steels for an oil sand slurry pipe currently being used are American Petroleum Institute (API) grade line pipe steels, wherein thermo-mechanical control process (TMCP) ferritic steels are used, in which, in order to increase abrasion resistance of the material, strength is increased to a level able to allow a pipe to be commercially produced. Hereinafter, techniques currently being used for pipe steels having excellent abrasion resistance will be described.

First, Korean Patent Application Laid-Open Publication No. 1987-0010217 discloses a method of securing abrasion resistance by installing a ceramic plate in a steel pipe, and Korean Patent Application Laid-Open Publication No. 2000-0046429 discloses a method of manufacturing an abrasion resistant pipe by forming a hardfacing weld layer on an inner surface of the pipe using tungsten carbide or high-chromium powder.

However, both patents disclose techniques in which a surface of a typical pipe is reprocessed by using a high hardness material in order to secure abrasion resistance, wherein high costs are incurred due to the fact that reprocessing and long-term abrasion resistance may not be assured, because the reprocessed layer may be detached due to external impacts or defects therein.

Next, Korean Patent Application Laid-Open Publication No. 2001-0066189 discloses a method of securing abrasion resistance and impact toughness by performing a carburization treatment on a surface of low carbon steel. However, a pipe surface hardened by the carburization treatment may not only have limitations in a welding zone, but rapid abrasion of a matrix structure may also occur after the abrasion of the surface hardened layer.

Also, Korean Patent Application Laid-Open Publication No. 2007-0017409 discloses a method of manufacturing steels having high mechanical strength and abrasion resistance, and the steels provided by the above patent have compositions including 0.30 wt %≤carbon (C)≤1.42 wt %; 0.05 wt %≤silicon (Si)≤1.5 wt %; manganese (Mn)≤1.95 wt %; nickel (Ni)≤2.9 wt %; 1.1 wt %≤chromium (Cr)≤7.9 wt %; 0.61 wt %≤molybdenum (Mo)≤4.4 wt %; selectively vanadium (V)≤1.45 wt %, niobium (Nb)≤1.45 wt %, tantalum (Ta)≤1.45 wt %, and V+Nb/2+Ta/4≤1.45 wt %; less than 0.1 wt % of boron, 0.19 wt % of (sulfur (S)+selenium (Se)/2+tellurium (Te)/4), 0.01 wt % of calcium, 0.5 wt % of a rare earth metal, 1 wt % of aluminum, and 1 wt % of copper; and iron as well as other unavoidable impurities as a remainder.

However, since the steels of the above invention contain carbon in an amount equal to or greater than that included in a medium carbon steel and large amounts of Ni, Cr, Mo, Nb, or V are used as alloying elements, manufacturing costs may not only be significantly increased, but mechanical strength may also be high. Therefore, the steels may not be suitable for a pipe material.

As another related art invention, Korean Patent Application Laid-Open Publication No. 2000-0041284 provides a method of manufacturing tool steels by spray forming, in which a method of increasing toughness by refining a size of carbide using Mo is disclosed. However, since manufacturing costs and strength may be high similar to the steel of Korean Patent Application Laid-Open Publication No. 2007-0017409, there may be limitations in using the steels as pipe materials.

Furthermore, Korean Patent Application Laid-Open Publication No. 2004-0059177 provides a method of manufacturing a steel having excellent abrasion resistance able to used for an oil pipe of a crude oil storage tank and piping in a ship's hull, wherein the steel according to the above patent is provided in such a manner that calcium (Ca)—Si in the form of a wire is added to a molten steel having a composition including 0.03 wt % to 0.1 wt % of C, 0.1 wt % to 0.3 wt % of Si, 0.05 wt % to 1.2 wt % of Mn, 0.05 wt % or less of phosphorous (P), 0.035 wt % or less of S, 0.03 wt % or less of aluminum (Al), 0.8 wt % to 1.1 wt % of Cr, 0.1 wt % to 0.3 wt % of copper (Cu), 0.1 wt % to 0.3 wt % of Ni, and iron (Fe) as well as other unavoidable impurities as a remainder, a degassing treatment is performed to control a Ca content to be in a range of 0.001 wt % to 0.004 wt %, and the steel is reheated to a temperature ranging from 1000° C. to 1200° C. and then hot-rolled at a temperature above $Ar_3$.

The above invention improves abrasion resistance and corrosion resistance by improving density of a rust layer using Cr, Cu, Ni, and Ca. However, it may be impossible to secure abrasion resistance and corrosion resistance by using the rust layer in a severely abrasive environment such as that of an oil sand slurry pipe.

Therefore, demand for a steel sheet for an oil sand slurry pipe having good economic factors and production efficiency as well as excellent abrasion resistance and corrosion resistance, even in a severely abrasive and corrosive environment, such as an operating environment of an oil sand slurry pipe, has rapidly increased.

SUMMARY OF THE INVENTION

An aspect of the present invention provides a steel sheet for an oil sand slurry pipe which may be formed into a pipe, and may also have good economic factors and production efficiency as well as excellent abrasion resistance, improved corrosion resistance, and excellent low-temperature impact toughness even in a severely abrasive environment, such as that of an oil sand slurry pipe, and a method of manufacturing the steel sheet.

According to an aspect of the present invention, there is provided a steel sheet for an oil sand slurry pipe having excellent abrasion resistance, corrosion resistance, and low-temperature toughness including: 0.2 wt % to 0.35 wt % of carbon (C); 0.1 wt % to 0.5 wt % of silicon (Si); 0.5 wt % to 1.8 wt % of manganese (Mn); 0.1 wt % to 0.6 wt % of nickel (Ni); 0.005 wt % to 0.05 wt % of niobium (Nb); 0.005 wt % to 0.02 wt % of titanium (Ti); 0.03 wt % or less of phosphorous (P); 0.03 wt % or less of sulfur (S); 0.05 wt % or less (excluding 0 wt %) of aluminum (Al); 0.01 wt % or less (excluding 0 wt %) of nitrogen (N); and iron (Fe) as well as other unavoidable impurities as a remainder.

The steel sheet may further include 0.1 wt % to 1.0 wt % or less (excluding 0 wt %) of chromium (Cr) and a sum of Mn and Cr may be 2 wt % or less.

Also, a sum of Mn, Cr, and Ni in the steel sheet may be 2.5 wt % or less.

A microstructure of the steel sheet may be composed of 50 area % to 80 area % of pearlite and ferrite as a remainder.

At this time, a spacing between pearlite grains may be 200 μm or less.

A Vickers hardness value of the steel sheet may be in a range of 180 Hv to 220 Hv.

According to another aspect of the present invention, there is provided a method of manufacturing a steel sheet for an oil sand slurry pipe having excellent abrasion resistance, corrosion resistance, and low-temperature toughness including: finish hot rolling a steel slab including 0.2 wt % to 0.35 wt % of carbon (C), 0.1 wt % to 0.5 wt % of silicon (Si), 0.5 wt % to 1.8 wt % of manganese (Mn), 0.1 wt % to 0.6 wt % of nickel (Ni), 0.005 wt % to 0.05 wt % of niobium (Nb), 0.005 wt % to 0.02 wt % of titanium (Ti), 0.03 wt % or less of phosphorous (P), 0.03 wt % or less of sulfur (S), 0.05 wt % or less (excluding 0 wt %) of aluminum (Al), 0.01 wt % or less (excluding 0 wt %) of nitrogen (N), and iron (Fe) as well as other unavoidable impurities as a remainder at a residual reduction rate of 50% or more and a temperature ranging from $Ar_3$ to $Ar_3$+200° C.; and then cooling at a cooling rate ranging from 0.2° C./sec to 4° C./sec.

The steel slab may further include 0.1 wt % to 1.0 wt % or less (excluding 0 wt %) of chromium (Cr) and a sum of Mn and Cr may be 2 wt % or less.

Also, a sum of Mn, Cr, and Ni in the steel slab may be 2.5 wt % or less.

The cooling may be initiated at a temperature ranging from $Ar_3$ to $Ar_3$+200° C. and may be terminated at a temperature of 500° C. or less.

According to an aspect of the present invention, a component system and a microstructure of steel may be controlled to obtain a steel sheet for an oil sand slurry pipe which may be produced as a pipe, and may also have good economic factors and production efficiency as well as excellent abrasion resistance, improved corrosion resistance, and excellent low-temperature impact toughness even in a severely abrasive environment such as that of an oil sand slurry pipe.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
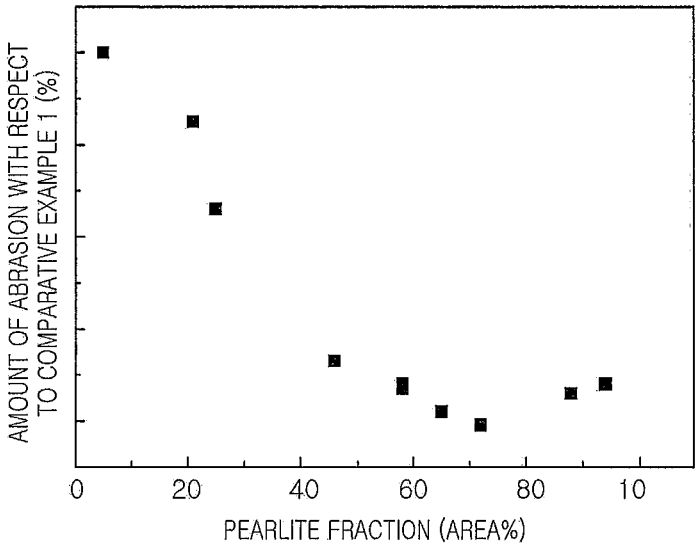
FIG. 1 is a graph schematically illustrating changes in wear rate according to a fraction of pearlite.
Figure 2:
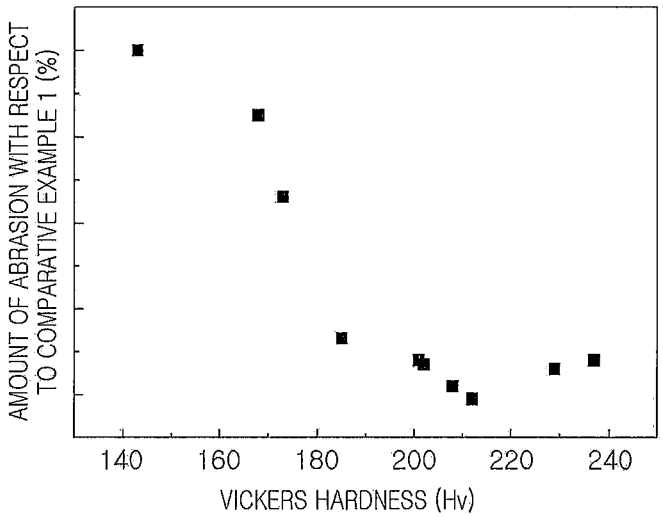
FIG. 2 is a graph schematically illustrating changes in wear rate according to Vickers hardness.

In general, low-carbon ferritic steels are easy to process and the control of the strength thereof may be facilitated by a thermo-mechanical control process (TMCP). However, abrasion resistance thereof may be low due to a low hardness value of a ferrite structure. In particular, since low-carbon ferritic steels may exhibit an erosion amount of 20 mm or more per year in a severely abrasive environment such as an operating environment of an oil sand slurry pipe, sufficient resistance to abrasion may generally not be obtained. As methods for addressing such limitations, performing a surface treatment on an inner wall of a pipe or increasing hardness of a material itself have typically been known.

However, according to a significant amount of research, the present inventors have recognized that abrasion of steel occurs due to surface deformation and the detachment of a deformed layer, and have found that a solution for improving abrasion resistance of a material is to provide hardness and toughness at the level in which the material may not be fractured while having impacted abrasive particles bouncing off therefrom, and simultaneously, to form a microstructure able to improve a deformation-carrying capacity.

Therefore, the present invention does not use a material having a high degree of hardness, such as bainite or martensite, but uses pearlite in consideration of the bouncing of the abrasive particles, based on a concept in which overall hardness of the pearlite itself is low but hardness of cementite is high. Thus, the present invention may further improve abrasion resistance.

Also, when considering the operating environment of the oil sand slurry pipe, a surface layer of the inside of the pipe is subjected to continuous abrasion as well as continuous corrosion due to salt and high temperature, and corrosion may proceed much faster in such an environment in which abrasion and corrosion occur simultaneously. Therefore, it is very important to secure corrosion resistance together with abrasion resistance. However, since there may be limitations in improving corrosion resistance by the formation of a surface oxide due to the foregoing abrasive environment, the present inventors have focused on improving corrosion resistance of a material itself, thereby leading to the addition of nickel (Ni).

In addition, a microstructure of the present invention includes a pearlite/ferrite mixed structure, in which a predetermined fraction thereof is composed of pearlite in consideration of the bouncing of abrasive particles and the remainder is composed of ferrite, as a basic structure. However, the mixed structure may have a low-temperature impact toughness lower than that of a ferrite structure. Therefore, the low-temperature toughness of the mixed structure may also be simultaneously improved by the refinement of austenite grains.

Hereinafter, a steel sheet of the present invention will be described.

According to an aspect of the present invention, there is provided a steel sheet for an oil sand slurry pipe having excellent abrasion resistance, corrosion resistance, and low-temperature toughness including: 0.2 wt % to 0.35 wt % of carbon (C), 0.1 wt % to 0.5 wt % of silicon (Si), 0.5 wt % to 1.8 wt % of manganese (Mn), 0.1 wt % to 0.6 wt % of nickel (Ni), 0.005 wt % to 0.05 wt % of niobium (Nb), 0.005 wt % to 0.02 wt % of titanium (Ti), 0.03 wt % or less of phosphorous (P), 0.03 wt % or less of sulfur (S), 0.05 wt % or less (excluding 0 wt %) of aluminum (Al), 0.01 wt % or less (excluding 0 wt %) of nitrogen (N), and iron (Fe) as well as other unavoidable impurities as a remainder.

Hereinafter, the above component system and composition range will be described in terms of weight percentage (wt %).

C: 0.2% to 0.35%

C is an element added for forming a ferrite/pearlite composite structure by the formation of pearlite in a ferrite matrix structure. In the case that a content thereof is less than 0.2%, abrasion resistance may not be secured due to an insufficient amount of pearlite, and in the case in which the content thereof is greater than 0.35%, the amount of pearlite may increase, but an amount of ferrite may excessively decrease to deteriorate a deformation-carrying capacity. Therefore, the content thereof may be controlled to be in a range of 0.2% to 0.35%. For example, in the case that C is controlled to be 0.25% or more in view of abrasion resistance, better resistance to abrasion may be obtained.

Si: 0.1% to 0.5%

Si not only acts as a deoxidizer in a steel-making process, but also increases the strength of steel. In the case that a content thereof is less than 0.1%, the above effect may not be sufficiently obtained, and in the case in which the content thereof is greater than 0.5%, impact toughness of a material may decrease, weldability thereof may decrease, and scale exfoliation may be induced during rolling. Therefore, the content of Si may be controlled to be in a range of 0.1% to 0.5%.

Mn: 0.5% to 1.8%

Mn is an element for increasing the amount of pearlite while not decreasing impact toughness, and may be added to an amount of 0.5% or more in order to sufficiently obtain the effect thereof. However, in the case that the amount thereof is too large, a pearlite structure may not be formed while a bainite or martensite structure may be formed and weldability may decrease. Therefore, the content thereof may be limited to a range of 0.5% to 1.8%.

Ni: 0.1% to 0.6%

Ni is an element added for securing corrosion resistance of a material itself, and also helps to improve strength and impact toughness. In order to sufficiently increase corrosion resistance by the addition of Ni, Ni may be added in an amount of 0.1% or more. However, in the case that the amount thereof is too large, a structure, such as bainite or martensite, may be formed. Thus, an upper limit thereof may be limited to 0.6%.

Nb: 0.005% to 0.05%

Nb is dissolved during the reheating of a slab to inhibit the growth of austenite grains during hot rolling, and subsequently, precipitates to improve the strength of steel. Thus, Nb is a key element for improving low-temperature toughness by grain refinement, in which Nb may be added in an amount of 0.005% or more in order to obtain the above effect. However, since impact toughness at a low temperature may be decreased in the case that the amount thereof is too large, an upper limit thereof may be limited to 0.05%.

Ti: 0.005% to 0.02%

Ti is an element which inhibits the growth of austenite grains by forming TiN through combination with N during the reheating of a slab, and plays a key role in improving low-temperature toughness by grain refinement similar to Nb. Therefore, Ti may be added to an amount of 0.005% or more in order to sufficiently obtain the above effect. However, since impact toughness at a low temperature may be decreased in the case that the amount thereof is too large, an upper limit thereof may be limited to 0.02%.

P: 0.03% or Less

Since P reduces weldability and decreases toughness, a content of p may be controlled to be as low as possible. Reduction of weldability, toughness, and abrasion resistance may be minimized by controlling the content of P to be 0.03% or less.

S: 0.03% or Less

S is an element which reduces ductility, impact toughness, and weldability. In particular, since S reduces abrasion resistance by forming MnS inclusions through the combination with Mn, a content of S may be controlled to be as low as possible, and the content thereof may be controlled to be 0.03% or less.

Al: 0.05% or Less (Excluding 0%)

Al acts as a deoxidizer for removing oxygen by reacting with the oxygen contained in a molten steel. However, since the impact toughness of a material is decreased by the formation of a large amount of oxide-based inclusions if an amount thereof is too large, an upper limit thereof may be limited to 0.05%.

N: 0.01% or Less (Excluding 0%)

N may prevent the growth of austenite grains by forming nitrides through the combination with Al, Ti, Nb, and vanadium (V), and as a result, may help to improve the toughness and strength of steel. However, if a content thereof is too high, N may exist in a dissolved state, and this may adversely affect the toughness of the steel. Therefore, the content thereof may be limited to 0.01% or less.

That is, according to an aspect of the present invention, the above component system and composition range is provided in consideration of a special environment in which an oil sand slurry pipe is used, and thus, the present invention may significantly contribute to improve abrasion resistance, corrosion resistance, and low-temperature toughness of a steel sheet for an oil sand slurry pipe.

The steel sheet may further include 0.1% to 1.0% or less of chromium (Cr) and a sum of Mn and Cr may be 2% or less. Cr may act to decrease a transformation temperature of steel and increase the amount of pearlite, and particularly, may change cementite from $Fe_3C$ into hard $(Fe,Cr)_3C$ to increase the abrasion resistance of the steel. Therefore, the abrasion resistance may be further increased in the case that Cr is further included. Cr may be added in an amount of 0.1% or more in order to obtain such effect.

However, in the case that the amount thereof is too large, since a low-temperature transformation structure, such as bainite or martensite, may form and may act as a cause of decreasing impact toughness, the content thereof may be limited to 1.5% or less. Simultaneously, since Mn as well as Cr may similarly act to decrease impact toughness due to the formation of the low-temperature transformation structure, a total content of Mn and Cr may be controlled to be 2.0% or less.

Also, a sum of Mn, Cr, and Ni in the steel sheet may be 2.5% or less. Ni is a key component for securing corrosion resistance of a material itself. However, since Ni may affect the reduction of impact toughness due to the formation of the low-temperature transformation structure by improving hardenability of the material, a total content of Mn, Cr, and Ni may be controlled to be 2.5% or less.

Furthermore, a microstructure of the steel sheet may be composed of 50 area % to 80 area % of pearlite and ferrite as a remainder. The present inventors have recognized that since the abrasion of steel occurs due to surface deformation and the detachment of a deformed layer, hardness of the steel may be sufficient if the hardness is at the level in which the steel may not be fractured while bouncing off abrasive particles, instead of forming a structure having a high degree of hardness such as bainite or martensite, in a severely abrasive environment such as the operating environment of an oil sand slurry pipe, and have found that improvement of the deformation-carrying capacity is more important.

Therefore, when pearlite is included in an amount of 50 area % or more, hardness at the level, in which the steel may not be fractured while bouncing off abrasive particles, may be obtained due to a high degree of hardness of cementite even in the case that overall hardness of pearlite may not be high, and simultaneously, excellent deformation-carrying capacity of ferrite may be obtained by limiting an area fraction of pearlite to be 80% or less and including ferrite as a remainder.

Thus, since the microstructure of the steel sheet according to the present invention is composed of a mixed structure of pearlite and ferrite and the fractions thereof are controlled as described above, the steel sheet may not be fractured while bouncing off abrasive particles and may also have excellent deformation-carrying capacity. Therefore, a steel sheet having excellent abrasion resistance in a severely abrasive environment, such as that of an oil sand slurry pipe, may be obtained.

Also, since the abrasion of a typical oil sand slurry pipe may generally occur by collision with abrasive particles having a diameter ranging from 200 μm to 300 μm, it may be more effective that a spacing between pearlite grains is smaller than the diameter of the abrasive particles, in order for the abrasive particles not to directly deform ferrite but to be bounced therefrom. Therefore, in order to prevent the abrasive particles from directly colliding with soft ferrite, the spacing between the pearlite grains may be controlled to be 200 μm or less so as to be smaller than the diameter of the abrasive particles.

In the case that the steel sheet has the foregoing component system and microstructure, a steel sheet having a Vickers hardness value ranging from 180 Hv to 220 Hv may be obtained. It is relatively important that the Vickers hardness value is maintained within the above range in the steel sheet for an oil sand slurry pipe. In the case that a hardness value of the matrix structure is less than 180 Hv, deformation caused by the abrasive particles may occur significantly due to the relatively low hardness value, and thus, abrasion resistance may be poor. In contrast, in the case in which the hardness value of the matrix structure is greater than 220 Hv, the hardness value may be high, but the deformation-carrying capacity thereof may be decreased, and this may result in a decrease in abrasion resistance. Therefore, the Vickers hardness value thereof may be controlled to be in a range of 180 Hv to 220 Hv.

Hereinafter, a method of manufacturing a steel sheet of the present invention will be described.

According to another aspect of the present invention, there is provided a method of manufacturing a steel sheet for an oil sand slurry pipe having excellent abrasion resistance, corrosion resistance, and low-temperature toughness, in which finish hot rolling is performed on a steel slab including 0.2 wt % to 0.35 wt % of C, 0.1 wt % to 0.5 wt % of Si, 0.5 wt % to 1.8 wt % of Mn, 0.1 wt % to 0.6 wt % of Ni, 0.005 wt % to 0.05 wt % of Nb, 0.005 wt % to 0.02 wt % of Ti, 0.03 wt % or less of P, 0.03 wt % or less of S, 0.05 wt % or less (excluding 0 wt %) of Al, 0.01 wt % or less (excluding 0 wt %) of N, and Fe as well as other unavoidable impurities as a remainder at a residual reduction rate of 50% or more and a temperature ranging from $Ar_3$ to $Ar_3$+200° C., and the steel slab is then cooled at a cooling rate ranging from 0.2° C./sec to 4° C./sec. The steel slab may further include 0.1% to 1.0% or less (excluding 0%) of Cr, and a sum of Mn and Cr may be 2% or less. Also, a sum of Mn, Cr, and Ni in the steel slab may be 2.5% or less.

First, finish hot rolling is performed on a steel slab having the foregoing composition at a residual reduction rate of 50% or more and a temperature ranging from $Ar_3$ to $Ar_3$+200° C. In the case that the finish rolling temperature is less than the $Ar_3$ point, phase transformation into austenite may not be sufficiently completed. In contrast, in the case in which the finish rolling temperature is greater than $Ar_3$+200° C., coarse austenite grains may be formed.

Also, since large amounts of hardenability improving elements, such as C, Mn, or Cr, are added to the steel slab used in the present invention, a mixed structure of pearlite and ferrite may not be obtained because a bainite or martensite structure is formed when cooling conditions are not controlled. Therefore, it may be relatively important to secure abrasion resistance suitable for the operating environment of an oil sand slurry pipe by obtaining the mixed structure of the present invention through the control of cooling conditions.

The cooling may be initiated at a temperature ranging from $Ar_3$ to $Ar_3$+200° C. and may be terminated at a temperature of 500° C. or less. In the case that the cooling initiation temperature is less than the $Ar_3$ point, cooling may be initiated in the state in which the phase transformation into austenite is not sufficiently completed, and thus, the structure targeted in the present invention may not be secured. In contrast, in the case in which the cooling initiation temperature is greater than $Ar_3$+200° C., it means that the rolling is performed above $Ar_3$+200° C., and thus, significant grain coarsening may occur. Therefore, the cooling initiation temperature may be limited to a temperature ranging from $Ar_3$ to $Ar_3$+200° C.

The hot rolling is performed on the steel slab having the foregoing composition and the steel slab may then be cooled at a cooling rate ranging from 0.2° C./sec to 4° C./sec. However, since a low-temperature transformation structure, such as bainite or martensite, may be formed in the case that the cooling rate is greater than 4° C./sec, the mixed structure of pearlite and ferrite may be difficult to obtain. Therefore, an upper limit thereof may be limited to 4° C./sec.

However, in the case in which the cooling rate is too low, such as less than 0.2° C./sec, pearlite may not be formed, but carbides may be spheroidized to form a structure in which the spheroidized carbides coexist with ferrite. In this case, sufficient hardness may not be secured and abrasion particles may directly collide with ferrite. Therefore, the cooling rate may be controlled to be 0.2° C./sec or more, and air cooling may be performed if the cooling rate of the air cooling is included within the above range.

Also, the cooling termination temperature may be limited to 500° C. or less. In the case that the cooling termination temperature is greater than 500° C., the entire structure may not be transformed from austenite into the pearlite/ferrite mixed structure, but a structure that is not transformed but remained as austenite may be obtained, and thus, a sufficient fraction of pearlite may not be secured. Therefore, the cooling termination temperature may be limited to 500° C. or less.

MODE FOR INVENTION

Hereinafter, the present invention will be described in detail, according to specific examples. However, the following individual example is merely provided to more clearly understand the present invention, not to limit the scope of the present invention.

Examples

First, molten steels having compositions listed in Table 1 were prepared, and steel slabs were then prepared by continuous casting. The cast slabs were hot rolled under typical conditions and cooling was performed under conditions listed in Table 2 to manufacture steel sheets.

TABLE 1

| Category | C | Si | Mn | P | S | Al | N | Ni | Nb | Ti | Cr |
|---|---|---|---|---|---|---|---|---|---|---|---|
| Inventive Steel 1 | 0.245 | 0.25 | 1.76 | 0.008 | 0.003 | 0.035 | 0.005 | 0.21 | 0.019 | 0.009 | — |
| Inventive Steel 2 | 0.253 | 0.18 | 1.55 | 0.009 | 0.007 | 0.037 | 0.008 | 0.23 | 0.018 | 0.008 | 0.11 |
| Inventive Steel 3 | 0.256 | 0.32 | 1.74 | 0.008 | 0.004 | 0.029 | 0.007 | 0.22 | 0.021 | 0.013 | 0.21 |
| Inventive Steel 4 | 0.297 | 0.44 | 1.49 | 0.008 | 0.006 | 0.041 | 0.005 | 0.21 | 0.022 | 0.012 | — |
| Inventive Steel 5 | 0.307 | 0.22 | 1.57 | 0.007 | 0.004 | 0.033 | 0.009 | 0.55 | 0.017 | 0.011 | 0.19 |
| Inventive Steel 6 | 0.312 | 0.23 | 0.92 | 0.007 | 0.002 | 0.035 | 0.003 | 0.34 | 0.033 | 0.010 | 0.78 |
| Inventive Steel 7 | 0.347 | 0.21 | 1.43 | 0.006 | 0.003 | 0.030 | 0.006 | 0.41 | 0.035 | 0.008 | — |
| Comparative Steel 1 | 0.041 | 0.23 | 1.21 | 0.006 | 0.0006 | 0.037 | 0.005 | 0.09 | 0.01 | 0.01 | 0.1 |
| Comparative Steel 2 | 0.066 | 0.16 | 1.56 | 0.009 | 0.0018 | 0.022 | 0.004 | 0.23 | 0.01 | 0.015 | 0.03 |
| Comparative Steel 3 | 0.055 | 0.15 | 2 | 0.007 | 0.0016 | 0.027 | 0.003 | 0.35 | 0.02 | 0.009 | 0.31 |
| Comparative Steel 4 | 0.25 | 0.29 | 1.29 | 0.006 | 0.0019 | 0.031 | 0.005 | 0.33 | 0.025 | 0.008 | 0.44 |
| Comparative Steel 5 | 0.384 | 0.22 | 1.57 | 0.007 | 0.004 | 0.033 | 0.009 | 0.43 | 0.023 | 0.01 | 0.21 |
| Comparative Steel 6 | 0.392 | 0.31 | 1.38 | 0.008 | 0.003 | 0.029 | 0.006 | 0.28 | 0.011 | 0.011 | 0.2 |
| Comparative Steel 7 | 0.259 | 0.32 | 1.92 | 0.006 | 0.004 | 0.029 | 0.007 | 0.15 | 0.009 | 0.015 | 0.19 |
| Comparative Steel 8 | 0.28 | 0.24 | 0.95 | 0.007 | 0.006 | 0.037 | 0.005 | 0.05 | 0.04 | 0.007 | 1.32 |
| Comparative Steel 9 | 0.291 | 0.23 | 1.50 | 0.008 | 0.003 | 0.036 | 0.005 | 0.13 | 0.004 | 0.012 | 0.23 |
| Comparative Steel 10 | 0.265 | 0.23 | 1.75 | 0.009 | 0.004 | 0.036 | 0.006 | 0.34 | 0.06 | 0.013 | 0.22 |
| Comparative Steel 11 | 0.254 | 0.27 | 1.54 | 0.007 | 0.003 | 0.029 | 0.007 | 0.46 | 0.019 | 0.003 | 0.19 |
| Comparative Steel 12 | 0.277 | 0.43 | 1.23 | 0.006 | 0.005 | 0.034 | 0.009 | 0.50 | 0.023 | 0.03 | 0.20 |

TABLE 2

| Category | Applied steel | Residual reduction rate (%) | $Ar_3$ (° C.) | Cooling initiation temperature (° C.) | Cooling rate (° C./s) | Cooling termination temperature (° C.) |
|---|---|---|---|---|---|---|
| Inventive Example 1 | Inventive Steel 1 | 55 | 697 | 750 | 0.4 | 300 |
| Inventive Example 2 | Inventive Steel 2 | 55 | 710 | 750 | 0.4 | 300 |
| Inventive Example 3 | Inventive Steel 3 | 55 | 692 | 750 | 1.0 | 250 |
| Inventive Example 4 | Inventive Steel 4 | 65 | 702 | 800 | 1.0 | 250 |
| Inventive Example 5 | Inventive Steel 5 | 65 | 690 | 800 | 3.5 | 400 |

TABLE 2-continued

| Category | Applied steel | Residual reduction rate (%) | $Ar_3$ (° C.) | Cooling initiation temperature (° C.) | Cooling rate (° C./s) | Cooling termination temperature (° C.) |
|---|---|---|---|---|---|---|
| Inventive Example 6 | Inventive Steel 6 | 65 | 731 | 800 | 3.5 | 400 |
| Inventive Example 7 | Inventive Steel 7 | 75 | 692 | 790 | 2.0 | 200 |
| Comparative Example 1 | Inventive Steel 1 | 55 | 716 | 770 | 6.0 | 100 |
| Comparative Example 2 | Inventive Steel 2 | 45 | 715 | 780 | 5.4 | 300 |
| Comparative Example 3 | Inventive Steel 3 | 55 | 715 | 770 | 0.1 | 200 |
| Comparative Example 4 | Inventive Steel 4 | 65 | 743 | 800 | 4.7 | 350 |
| Comparative Example 5 | Inventive Steel 5 | 65 | 743 | 800 | 1.0 | 600 |
| Comparative Example 6 | Comparative Steel 1 | 55 | 803 | 750 | 0.4 | 200 |
| Comparative Example 7 | Comparative Steel 2 | 55 | 768 | 750 | 0.4 | 250 |
| Comparative Example 8 | Comparative Steel 3 | 65 | 732 | 750 | 0.4 | 300 |
| Comparative Example 9 | Comparative Steel 4 | 65 | 773 | 800 | 16.1 | 300 |
| Comparative Example 10 | Comparative Steel 5 | 75 | 666 | 800 | 2.5 | 300 |
| Comparative Example 11 | Comparative Steel 6 | 75 | 679 | 850 | 2.5 | 350 |
| Comparative Example 12 | Comparative Steel 7 | 55 | 672 | 750 | 0.3 | 200 |
| Comparative Example 13 | Comparative Steel 8 | 55 | 687 | 750 | 1.2 | 150 |
| Comparative Example 14 | Comparative Steel 9 | 65 | 687 | 780 | 1.2 | 150 |
| Comparative Example 15 | Comparative Steel 10 | 65 | 688 | 780 | 3.5 | 350 |
| Comparative Example 16 | Comparative Steel 11 | 70 | 684 | 810 | 3.5 | 350 |
| Comparative Example 17 | Comparative Steel 12 | 70 | 656 | 810 | 3.5 | 300 |

Configurations of microstructures were analyzed in the steel sheets manufactured by the above conditions, fractions of pearlite and hardness were measured, and the results thereof are presented in Table 3 below. In order to evaluate abrasion resistance and corrosion resistance, an amount of abrasion and a polarization resistance value were measured for each steel sheet and represented as a ratio to Comparative Example 1 or 6. Also, in order to evaluate low-temperature toughness, Charpy impact absorption energy was measured at −45° C. for each steel sheet, and the results thereof are also presented in Table 3 below.

TABLE 3

| Category | Microstructure | Pearlite fraction (area %) | Hardness (Hv) | Wear rate (%) with respect to Comparative Example 1 | Polarization resistance ratio (%) with respect to Comparative Example 6 | Charpy impact energy (J) |
|---|---|---|---|---|---|---|
| Inventive Example 1 | Pearlite/ferrite | 60 | 200 | 40 | 141 | 83 |
| Inventive Example 2 | Pearlite/ferrite | 70 | 210 | 35 | 136 | 87 |
| Inventive Example 3 | Pearlite/ferrite | 55 | 185 | 57 | 130 | 88 |
| Inventive Example 4 | Pearlite/ferrite | 65 | 205 | 42 | 148 | 93 |
| Inventive Example 5 | Pearlite/ferrite | 60 | 200 | 38 | 143 | 88 |
| Inventive Example 6 | Pearlite/ferrite | 75 | 215 | 35 | 155 | 91 |
| Inventive Example 7 | Pearlite/ferrite | 70 | 210 | 37 | 144 | 101 |
| Comparative Example 1 | Martensite | — | 350 | 100 | 135 | 19 |

TABLE 3-continued

| Category | Microstructure | Pearlite fraction (area %) | Hardness (Hv) | Wear rate (%) with respect to Comparative Example 1 | Polarization resistance ratio (%) with respect to Comparative Example 6 | Charpy impact energy (J) |
|---|---|---|---|---|---|---|
| Comparative Example 2 | Bainite | — | 320 | 120 | 133 | 12 |
| Comparative Example 3 | Ferrite(spherical carbide) | — | 135 | 150 | 134 | 110 |
| Comparative Example 4 | Bainite | — | 300 | 95 | 135 | 25 |
| Comparative Example 5 | Austenite/ferrite | — | 120 | 140 | 140 | 115 |
| Comparative Example 6 | Ferrite | — | 130 | 135 | 100 | 98 |
| Comparative Example 7 | Ferrite | — | 130 | 125 | 135 | 89 |
| Comparative Example 8 | Bainite | — | 290 | 90 | 138 | 28 |
| Comparative Example 9 | Martensite | — | 340 | 105 | 136 | 18 |
| Comparative Example 10 | Pearlite/ferrite | 90 | 240 | 70 | 135 | 80 |
| Comparative Example 11 | Pearlite/ferrite | 92 | 250 | 80 | 138 | 82 |
| Comparative Example 12 | Bainite | — | 290 | 98 | 129 | 30 |
| Comparative Example 13 | Pearlite/ferrite | 55 | 183 | 58 | 90 | 80 |
| Comparative Example 14 | Pearlite/ferrite | 60 | 200 | 45 | 140 | 35 |
| Comparative Example 15 | Pearlite/ferrite | 53 | 183 | 54 | 132 | 40 |
| Comparative Example 16 | Pearlite/ferrite | 57 | 187 | 53 | 130 | 36 |
| Comparative Example 17 | Pearlite/ferrite | 55 | 185 | 57 | 135 | 42 |

Inventive Examples 1 to 7 used inventive steels and the cooling conditions after the hot rolling also within the range of the present invention, and thus, microstructures thereof were mixed structures including pearlite having a fraction ranging from 55% to 75% and ferrite as a remainder, and hardness values were in a range of 185 Hv to 215 Hv. That is, since the microstructures included a ferrite structure ranging from 25 area % to 45 area % while having sufficient hardness values able to resist abrasion, deformation-carrying capacities were also excellent, and thus, amounts of abrasion with respect to that of Comparative Example 1 were relatively low, such as a range of 35% to 57%. Therefore, it may be confirmed that abrasion resistance levels were excellent. Also, since Ni was also included within the range of the present invention, polarization resistance ratios with respect to Comparative Example 6 were relatively high, such as a range of 130% to 155%, and thus, it may be confirmed that excellent corrosion resistances were obtained. Furthermore, since contents of Nb and Ti and residual reduction rates were also included within the ranges of the present invention, values of Charpy impact absorption energy obtained were 80 J or more, and thus, it may be understood that low-temperature toughness of Inventive Examples 1 to 7 was excellent.

Since the cooling rates of Comparative Examples 1, 2, 4 and 9 were too high, a low-temperature transformation structure, such as bainite or martensite, was obtained, and thus, relatively high hardness values were obtained. In contrast, since deformation-carrying capacities were poor, actual amounts of abrasion with respect to Comparative Example 1 were relatively high, such as a range of 95% to 120%, and thus, it may be understood that abrasion resistance levels were poor. Also, since the low-temperature transformation structures were obtained, values of impact absorption energy were low. In particular, it may be confirmed that low-temperature toughness of Comparative Example 2 was particularly poor because the residual reduction rate thereof was less than 50%.

In contrast, the cooling rate of Comparative Example 3 was too low, carbides did not form pearlite, but were spheroidized to form a structure in which spherical carbides and ferrite coexisted. As a result, the hardness value thereof was low at 135 Hv and the amount of abrasion with respect to Comparative Example 1 thereof was 150%, and thus, it may be confirmed that abrasion resistance was relatively poor.

The cooling termination temperature of Comparative Example 5 was 600° C., and since the temperature exceeded 500° C., austenite was not entirely transformed and remained. Thus, the hardness value thereof was low at 120 Hv and as a result, the amount of abrasion with respect to Comparative Example 1 thereof was relatively high at 140%.

In Comparative Examples 6 and 7, since the contents of carbon were significantly low, pearlite structures were almost not presented and ferrite single structures were presented. As a result, hardness values were low at 130 Hv and accordingly, amounts of abrasion with respect to Comparative Example 1 were relatively high, such as a range of 125% to 135%. In particular, since the Ni content of Comparative Example 6 was too low, the polarization resistance value thereof was low, and thus, corrosion resistance was poor.

Since Mn contents of Comparative Examples 8 and 12 were too high, a low-temperature transformation structure, such as bainite, was obtained, and as a result, hardness values were high at 290 Hv. However, since deformation-carrying capacities were low, amounts of abrasion with respect to Comparative Example 1 were in a range of 90% to 98%. Thus, it may be confirmed that abrasion resistance levels were poor.

With respect to Comparative Examples 10 and 11, since the contents of carbon were too high, the amounts of pearlite were significantly increased, and as a result, hardness values were increased to a range of 240 Hv to 250 Hv. However, since the amounts of ferrite were small, such as a range of 8 area % to 10 area %, deformation-carrying capacities were decreased, and as a result, amounts of abrasion with respect to Comparative Example 1 were in a range of 70% to 80%. Thus, it may be confirmed that abrasion resistance levels were poor in comparison to the inventive examples.

With respect to Comparative Examples 13 to 15, since composition ranges of Nb and Ti, which significantly affect the refinement of grains, deviated from the ranges of the present invention, it may be expected that coarse grains were obtained. As a result, values of Charpy impact absorption energy were relatively low, and thus, it may be confirmed that low-temperature toughness was poor.

Also, in order to more clearly identify the relationship between abrasiveness vs. the faction of pearlite and Vickers hardness, the present inventors conducted experiments for identifying amounts of abrasion with respect to Comparative Example 1 according to changes in the area fraction of pearlite and Vicker hardness by changing the composition of steel. As a result, in the case that the fraction of pearlite was in a range of 50 area % to 80 area % and the Vickers hardness was in a range of 180 Hv to 220 Hv, the amount of abrasion with respect to Comparative Example 1 was the lowest and thus, it may be confirmed that abrasion resistance was highest.

While the present invention has been shown and described in connection with the exemplary embodiments, it will be apparent to those skilled in the art that modifications and variations can be made without departing from the spirit and scope of the invention as defined by the appended claims.

The invention claimed is:

1. A steel sheet for an oil sand slurry pipe having excellent abrasion resistance, corrosion resistance, and low-temperature toughness, the steel sheet comprising:

0.2 wt % to 0.35 wt % of carbon (C);
0.1 wt % to 0.5 wt % of silicon (Si);
0.5 wt % to 1.8 wt % of manganese (Mn);
0.1 wt % to 0.6 wt % of nickel (Ni);
0.005 wt % to 0.05 wt % of niobium (Nb);
0.005 wt % to 0.02 wt % of titanium (Ti);
0.03 wt % or less of phosphorous (P);
0.03 wt % or less of sulfur (S);
0.05 wt % or less (excluding 0 wt %) of aluminum (Al);
0.01 wt % or less (excluding 0 wt %) of nitrogen (N); and
iron (Fe) as well as other unavoidable impurities as a remainder, wherein a microstructure of the steel sheet is composed of 50 area % to 80 area % of pearlite and ferrite as a remainder.

2. The steel sheet for an oil sand slurry pipe having excellent abrasion resistance, corrosion resistance, and low-temperature toughness of claim 1, further comprising 0.1 wt % to 1.0 wt % or less (excluding 0 wt %) of chromium (Cr), wherein a sum of Mn and Cr is 2 wt % or less.

3. The steel sheet for an oil sand slurry pipe having excellent abrasion resistance, corrosion resistance, and low-temperature toughness of claim 2, wherein a sum of Mn, Cr, and Ni in the steel sheet is 2.5 wt % or less.

4. The steel sheet for an oil sand slurry pipe having excellent abrasion resistance, corrosion resistance, and low-temperature toughness of claim 1, wherein a spacing between pearlite grains is 200 μm or less.

5. The steel sheet for an oil sand slurry pipe having excellent abrasion resistance, corrosion resistance, and low-temperature toughness of claim 4, wherein a Vickers hardness value of the steel sheet is in a range of 180 Hv to 220 Hv.

6. A method of manufacturing a steel sheet for an oil sand slurry pipe having excellent abrasion resistance, corrosion resistance, and low-temperature toughness, the method comprising:

finish hot rolling a steel slab including 0.2 wt % to 0.35 wt % of carbon (C), 0.1 wt % to 0.5 wt % of silicon (Si), 0.5 wt % to 1.8 wt % of manganese (Mn), 0.1 wt % to 0.6 wt % of nickel (Ni), 0.005 wt % to 0.05 wt % of niobium (Nb), 0.005 wt % to 0.02 wt % of titanium (Ti), 0.03 wt % or less of phosphorous (P), 0.03 wt % or less of sulfur (S), 0.05 wt % or less (excluding 0 wt %) of aluminum (Al), 0.01 wt % or less (excluding 0 wt %) of nitrogen (N), and iron (Fe) as well as other unavoidable impurities as a remainder at a residual reduction rate of 50% or more and a temperature ranging from $Ar_a$ to $Ar_3$+200° C.; and then cooling at a cooling rate ranging from 0.2° C./sec to 4° C./sec to obtain a steel sheet having a microstructure composed of 50 area % to 80 area % of pearlite and ferrite as a remainder.

7. The method of claim 6, wherein the steel slab further comprises 0.1 wt % to 1.0 wt % or less (excluding 0 wt %) of chromium (Cr) and a sum of Mn and Cr is 2 wt % or less.

8. The method of claim 7, wherein a sum of Mn, Cr, and Ni in the steel slab is 2.5 wt % or less.

9. The method of claim 6, wherein the cooling is initiated at a temperature ranging from $Ar_3$ to $Ar_3$+200° C. and is terminated at a temperature of 500° C. or less.

10. The method of claim 7, wherein the cooling is initiated at a temperature ranging from $Ar_3$ to $Ar_3$+200° C. and is terminated at a temperature of 500° C. or less.

11. The method of claim 8, wherein the cooling is initiated at a temperature ranging from $Ar_3$ to $Ar_3$+200° C. and is terminated at a temperature of 500° C. or less.

12. An oil sand slurry pipe having excellent abrasion resistance, corrosion resistance, and low-temperature toughness, the oil sand slurry pipe being formed from a steel sheet comprising:

0.2 wt % to 0.35 wt % of carbon (C);
0.1 wt % to 0.5 wt % of silicon (Si);
0.5 wt % to 1.8 wt % of manganese (Mn);
0.1 wt % to 0.6 wt % of nickel (Ni);
0.005 wt % to 0.05 wt % of niobium (Nb);
0.005 wt % to 0.02 wt % of titanium (Ti);
0.03 wt % or less of phosphorous (P);
0.03 wt % or less of sulfur (S);
0.05 wt % or less (excluding 0 wt %) of aluminum (Al);
0.01 wt % or less (excluding 0 wt %) of nitrogen (N); and
iron (Fe) as well as other unavoidable impurities as a remainder, wherein a microstructure of the steel sheet is composed of 50 area % to 80 area % of pearlite and ferrite as a remainder.

13. The oil sand slurry pipe having excellent abrasion resistance, corrosion resistance, and low-temperature toughness of claim 12, further comprising 0.1 wt % to 1.0 wt % or less (excluding 0 wt %) of chromium (Cr), wherein a sum of Mn and Cr is 2 wt % or less.

14. The oil sand slurry pipe having excellent abrasion resistance, corrosion resistance, and low-temperature toughness of claim 13, wherein a sum of Mn, Cr, and Ni in the steel sheet is 2.5 wt % or less.

15. The oil sand slurry pipe having excellent abrasion resistance, corrosion resistance, and low-temperature toughness of claim 12, wherein a spacing between pearlite grains is 200 μm or less.

16. The oil sand slurry pipe having excellent abrasion resistance, corrosion resistance, and low-temperature toughness of claim 12, wherein a Vickers hardness value of the steel sheet is in a range of 180 Hv to 220 Hv.

* * * * *

UNITED STATES PATENT AND TRADEMARK OFFICE

CERTIFICATE OF CORRECTION

PATENT NO. : 9,238,849 B2
APPLICATION NO. : 13/996563
DATED : January 19, 2016
INVENTOR(S) : Seong-Ung Koh et al.

It is certified that error appears in the above-identified patent and that said Letters Patent is hereby corrected as shown below:

In the claims,

Column 16, Line 22, Claim 6, delete "$Ar_a$" and insert -- $Ar_3$ --

Signed and Sealed this
Third Day of May, 2016

Michelle K. Lee

Michelle K. Lee
*Director of the United States Patent and Trademark Office*